US006303884B1

(12) United States Patent
Hou et al.

(10) Patent No.: US 6,303,884 B1
(45) Date of Patent: Oct. 16, 2001

(54) SAFETY CONTROLLER SERVING AS A POWER SWITCH

(75) Inventors: Jen-En Hou, Pu Tzu; Kun-Chung Lin, Cha-I, both of (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 09/518,536

(22) Filed: Mar. 4, 2000

(51) Int. Cl.[7] ..... H01H 3/14
(52) U.S. Cl. ..... 200/86.5; 200/343
(58) Field of Search ..... 200/529, 86.5, 200/551, 332.1, 343, 339

(56) References Cited

U.S. PATENT DOCUMENTS 3,553,405 * 1/1971 Guettinger ..... 200/86.5
5,166,513 * 11/1992 Keenan et al. ..... 250/221
5,180,925 * 1/1993 Lieb ..... 307/114
6,028,274 * 2/2000 Harris ..... 200/52 R

* cited by examiner

*Primary Examiner*—Paula Bradley
*Assistant Examiner*—Nhung Nguyen
(74) *Attorney, Agent, or Firm*—W. Wayne Liauh

(57) ABSTRACT

This invention discloses a safety controller for use with a power switch for turning on or off the power switch. Two pressing actuators are provided in the design of the control pedal of the invention, having slant surfaces tilting in opposite directions. When the user steps on the control pedal, the first pressing actuator presses the button on the power switch to turn on the power; whereas when the control pedal is restored, the second pressing actuator presses the button on the power switch to turn off the power.

10 Claims, 5 Drawing Sheets

SAFETY CONTROLLER SERVING AS A POWER SWITCH

BACKGROUND OF THE INVENTION

1. Field of Invention

The present invention relates to a safety controller which servers as a power switch and, in particular, to a safety device for controlling the on and off of a power switch on a children toy such as for controlling the motion of a children's ride-on vehicle.

2. Description of Related Art

The current popular children's ride-on vehicle mainly includes a body, a plurality of wheels mounted thereon, a motor for driving the wheels, and a battery as the power supply of the motor. In particular, the battery is connected to a power switch; which is used to control the driving power of the motor. A controller is provided on the children's ride-on vehicle to control the power switch. Manipulation of the controller can control the motion of the vehicle. Therefore, this controller is similar to the gas pedal of a car. A control mechanism on an on-off switch of a children's ride-on vehicle is disclosed in the U.S. Pat. No. 5,051,550. This control mechanism operable for selectively moving an on-off switch into on and off positions includes an on-off switch mounted on a base and having a button with opposed, first and second ends simultaneously movable in opposite directions, an actuating pedal disposed adjacent the on-off switch selectively movable for engaging the first end of the on-off switch and urging it in a first direction to an on position accompanied by movement of the second end of the on-off switch in the opposite direction, and a biasing device disposed adjacent the on-off switch and externally thereof for engaging the second end of the on-off switch and normally maintaining it in the off position. The biasing device yieldably resists movement of the actuator when it engages the first end of the on-off switch and moves it in the first direction toward the on position. When the actuating pedal is depressed, the first end is engaged to turn on the power and interconnects the battery and the motor; whereas when the pedal is released, the spring restores the pedal to its original position and simultaneously engages the second end to turn off the power.

The pressing and pedal engaging directions of the power switch button in the above-referred patent are horizontal, which means that the power switch is mounted vertically. This configuration requires a larger longitudinal space. However, different types of children ride-on vehicles have different designs. Some of them may not be able to provide sufficient longitudinal space and a reconfiguration of the power switch is needed.

SUMMARY OF THE INVENTION

It is then a main object of the present invention to provide a safety controller for use with a power switch.

The safety controller disclosed in the invention applies to turn the power switch on and off. A control pedal is formed with a clip spring fixed on a base so that the control pedal can be pressed with the clip spring portion as the pivot. A power switch is horizontally disposed on one side of the control pedal. Two pressing actuators are provided at the positions opposite to the power switch button, the two pressing actuators having slant surfaces tilting in opposite directions. When the control pedal is stepped on, the first pressing actuator pushes one end of the power switch button to turn on the power; whereas when the control pedal is released and restored to its original position, the second pressing actuator pushes the other end of the power switch button to turn off the power.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

As described at the outset, it is a principal object of the present invention to provide a safety controller for use with a power switch having applicability to controlling the motion of toys such as children's ride-on vehicles.

Figure 1:
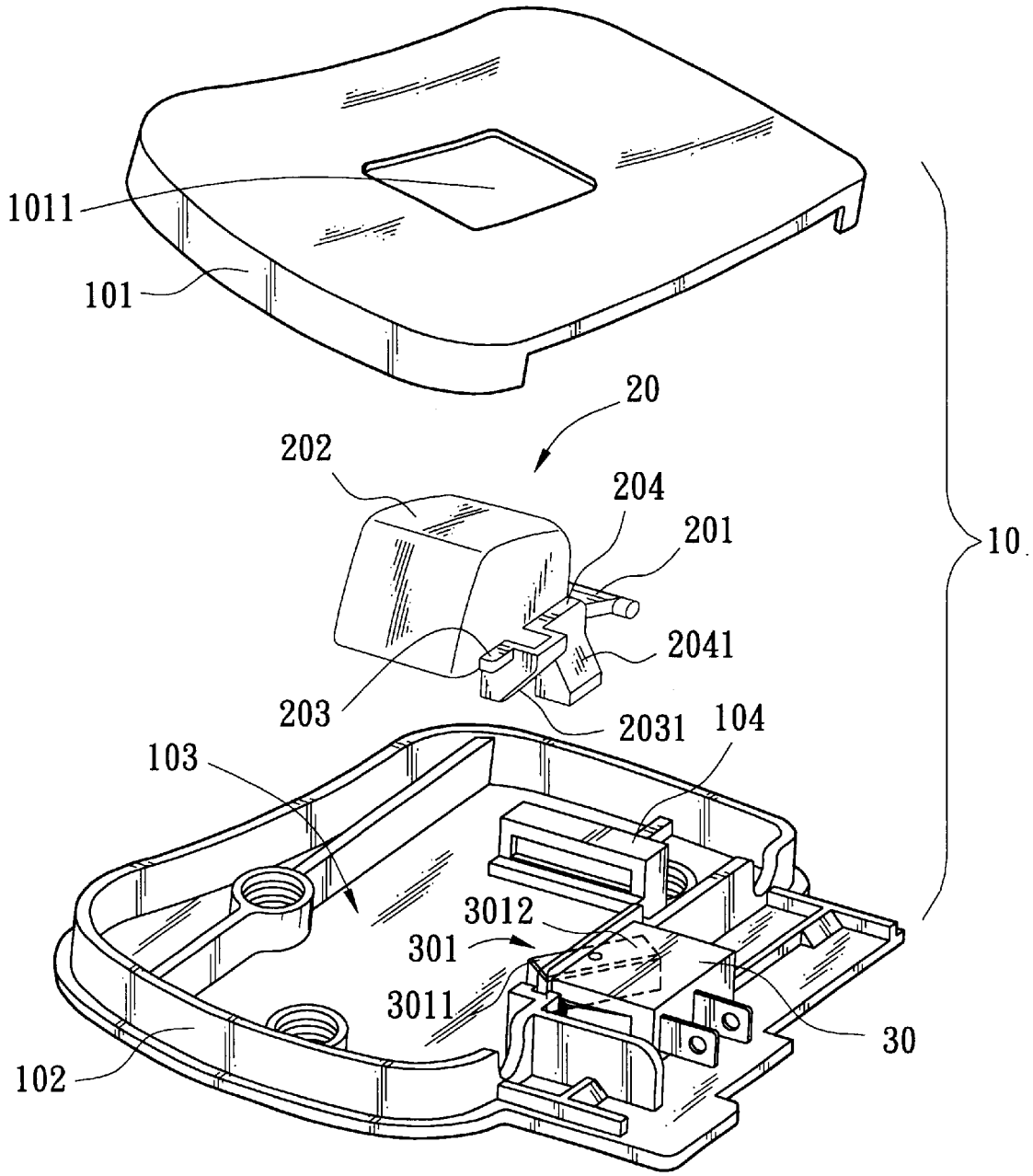
FIG. 1 schematically shows an exploded structure of the present invention.
Figure 2:
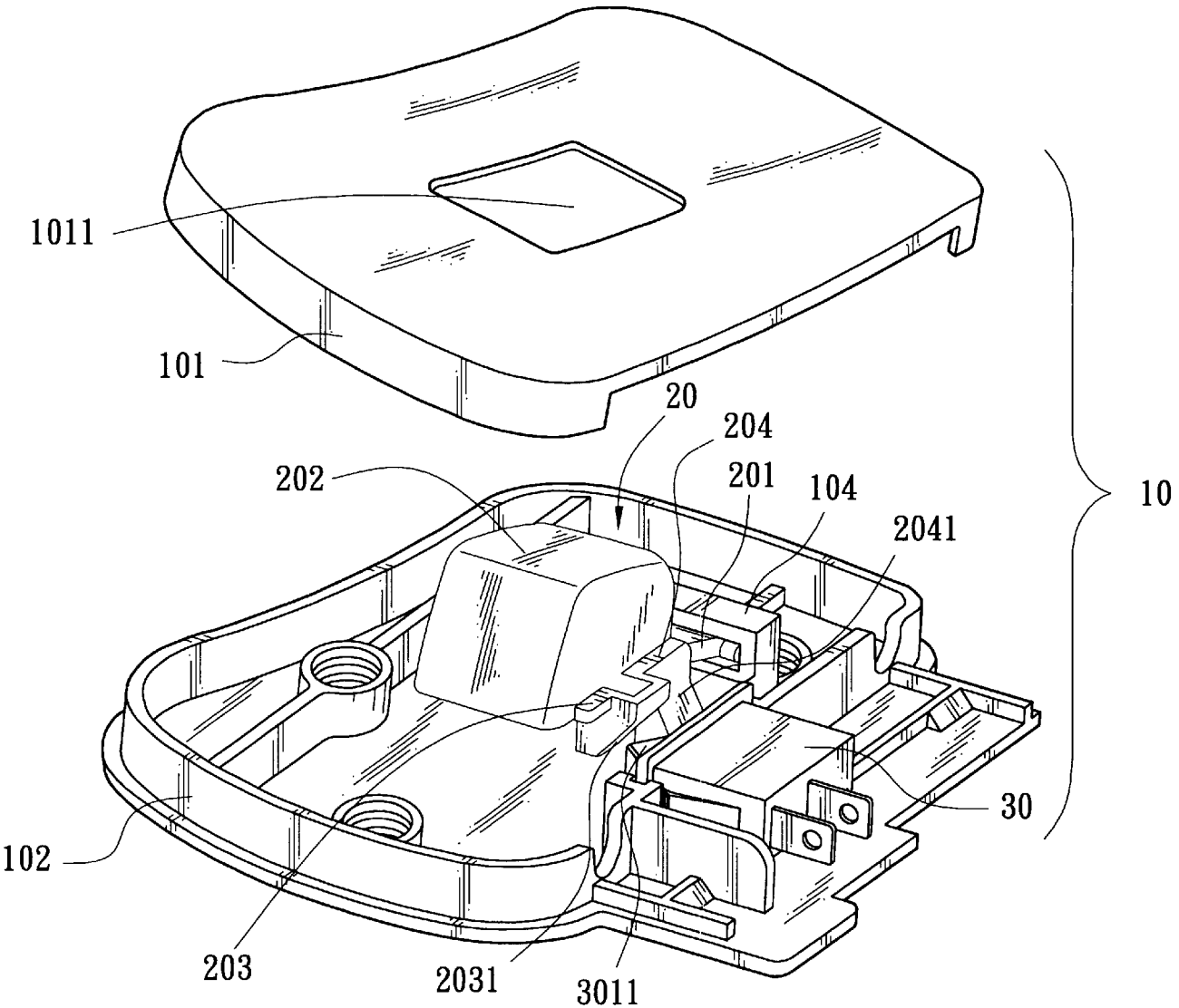
FIG. 2 schematically shows a structure assembly of the present invention.
Figure 3B:
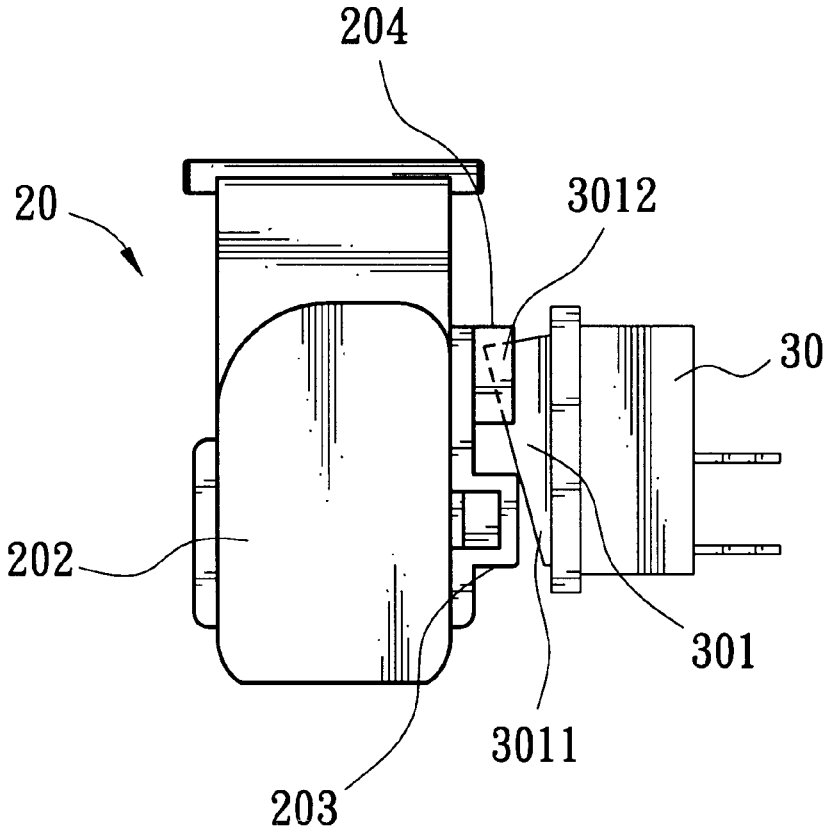
FIGS. 3A and 3B are a set of schematic views showing the actions of the present invention.
Figure 3A:
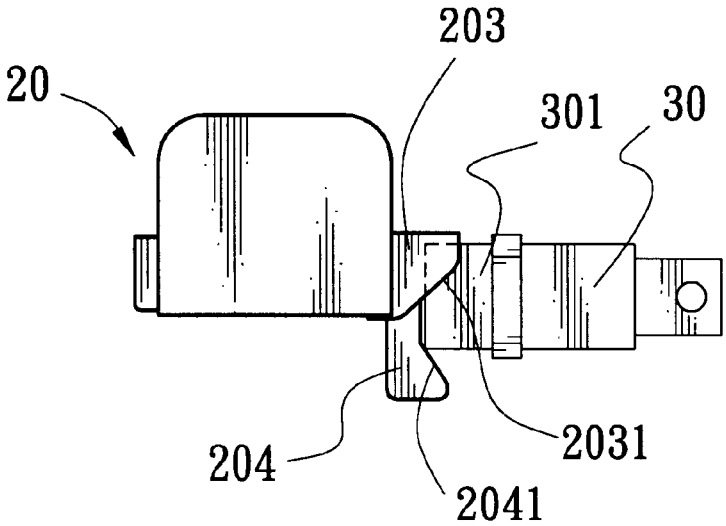
Figure 4B:
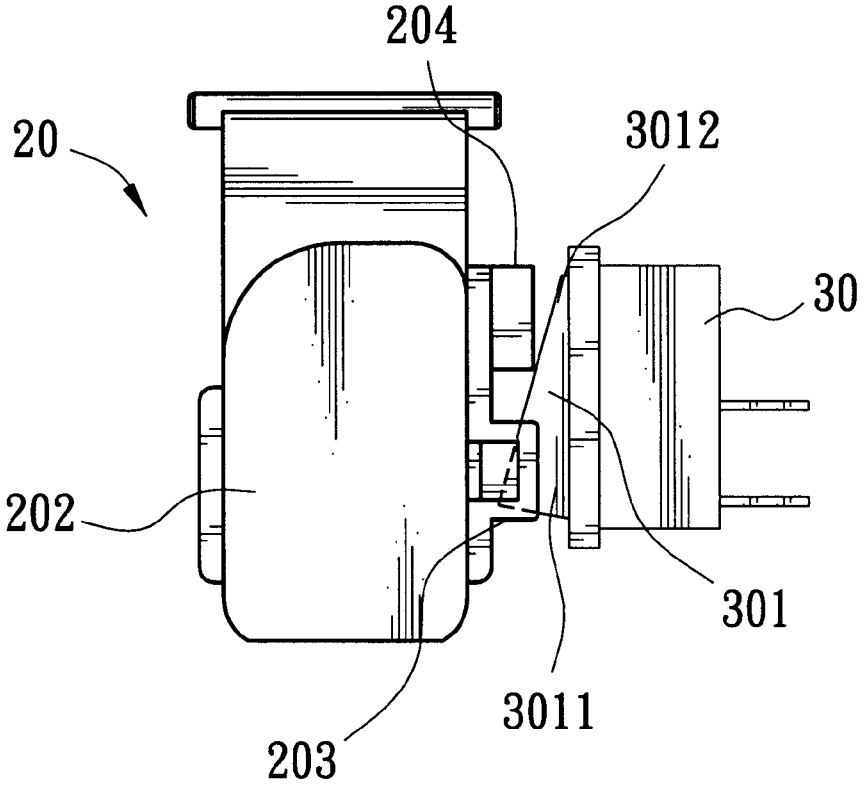
FIGS. 4A and 4B are another set of schematic views showing the actions of the present invention.
Figure 4A:
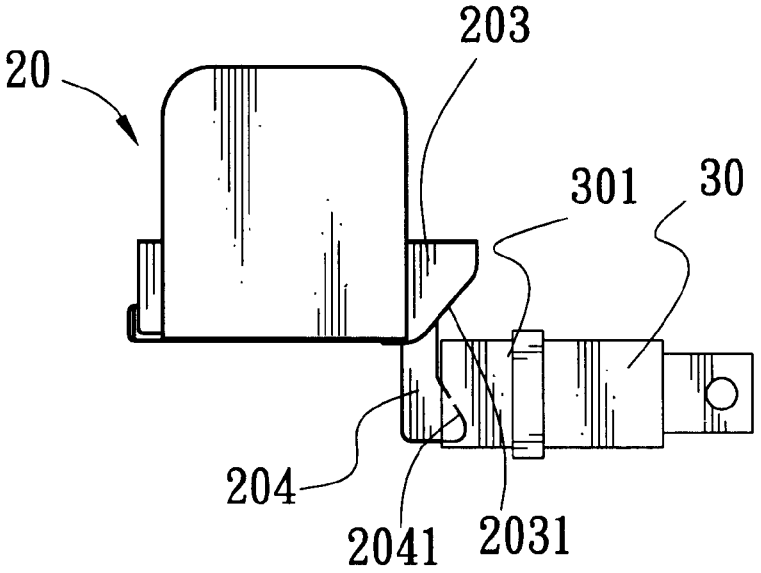

As shown in FIGS. 1 and 2, the safety controller of the power switch or more appropriately, a power switch with a safety controller comprises a base 10, a control pedal 20, and a power switch 30.

The base 10 comprises an upper cover 101 and a lower fixing board 102 with a housing space 103 formed in between. A window 1011 is formed on the upper cover 101, and a connector base 104 is provided at the back of the lower fixing board 102.

The control pedal 20 is mounted within the housing space 103 of the base 10. The control pedal 20 comprises a clip spring 201 and a pushing actuator 202, the clip spring 201 being provided at the rear end of the pushing actuator 202. The control pedal 20 is fixed onto the connector base 104 by the clip spring 201 to be maintained at a certain height thereby and to be movable with the spring tension of the clip spring 201. First pressing actuator 203 and second pressing actuator 204 are provided on one side of the pushing actuator, the first actuator 203 and the second pressing actuator comprising a slant surface 2031 and a slant surface 2041 tilted at an angle in opposite directions, respectively. The slant surfaces 2031, 2041 can be curved surfaces.

The power switch 30 is an on-off switch disposed on the lower fixing board 102 at a suitable position to the right side of the first pressing actuator 203 and the second pressing actuator 204 of the control pedal 20. The power switch 30 interconnects a battery with a driving motor (not shown) with connecting wires to control whether the power is supplied to the driving motor for action. In particular, the central position of the power switch 30 is provided with a button 301, which has a first end 3011 and a second end 3012 with opposite movement. That is, when the first end 3011 is depressed the second end rises, and vice versa. In an embodiment, the depression of the first end 3011 allows the electrical current to pass through the switch and drive the motor, while the depression of the second end 3012 disconnects the circuit.

With reference to FIGS. 3A, 3B, 4A, and 4B, the control pedal 20 is normally above the button 301 of the power switch 30, with the first pressing actuator 203 opposed to the first end 3011 and the second pressing actuator 204 opposed to the second end 3012. The second end 3012 of the button 301 normally depresses the second end 3012 of the button 301 (i.e., the first end 3011 is upward and the power is off). The user can depress or step on the pushing actuator 202 downwardly so that the first pressing actuator 203 moves downwardly to depress the first end 3011 of the button 301 using the slant surface 2031. At this state, the power is turned on and the second end 3012 of the button 301 is upward with the second pressing actuator 204 moving to the position under the second end 3012 of the button 301. When the pressure of the pushing actuator 202 is released, the pushing actuator 202 restores its normal position with the help of the clip spring 201 (hidden behind the pushing actuator 202) and the second pressing actuator 204 simultaneously depresses the second end 3012 of the button 301 using the slant surface 2031 during the restoration stroke to turn off the power.

Figure 5:
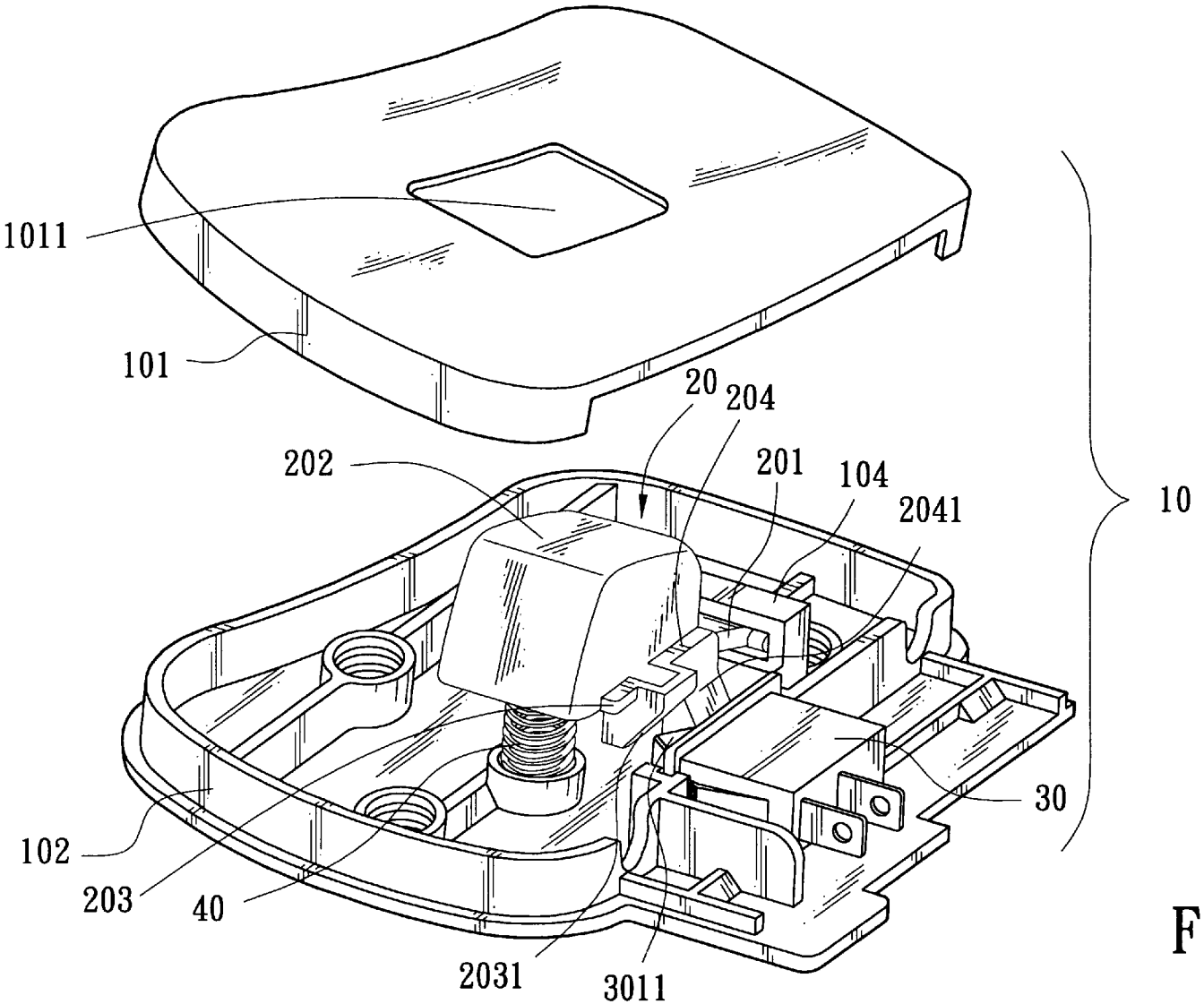
FIG. 5 schematically shows an embodiment of the present invention.

As shown in FIG. 5, the clip spring 201 can be pivotally connected to the connector base 104 without fixing. A spring element 40, which can be a compressible spring, is provided under the pushing actuator 202 with one end being opposed to the lower fixing board 102 and the other end supporting the pushing actuator 202. The pushing actuator 202 is thus normally above the button 301 and uses the spring element 40 as the restoration force. Similarly, the first pressing actuator 203 and the second pressing actuator 204 are used to depress the first end 3011 and the second end 3012 of the button 301 to turn on and off the power, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A safety controller with a power switching function, comprising a control pedal, a base and a power switch, wherein:

the power switch is mounted on the base and comprises a button having a first end and a second end, which can simultaneously move in opposite directions for turning the power on and off;

the control pedal comprises a clip spring with one end fixed onto the base and a pushing actuating means, and further connects to a first pressing actuating means and a second pressing actuating means, the first pressing actuating means and the second actuating means moving simultaneously with the control pedal to depress the first end and the second end of the button, respectively, and the second pressing actuating means normally depresses the second end of the button to keep the power off by the spring tension of the clip spring;

further wherein the first pressing actuating means and the second actuating means have slant surfaces tilted in opposite directions.

2. The safety controller of claim 1, wherein the base comprises a lower fixing board and an upper cover, the upper cover being movably mounted on the lower fixing board.

3. The safety controller of claim 1, wherein the slant surface of the first pressing actuating means engages the button to turn on the power when the control pedal is stepped downwardly.

4. The safety controller of claim 1, wherein the slant surface of the second pressing actuating means disengages the button to turn off the power when the control pedal is released and restored back to its normal state.

5. The safety controller of claim 1, wherein the slant surfaces of the first pressing actuating means and the second actuating means are curved surfaces.

6. A safety controller with a power switching function, comprising a control pedal, a spring element, a base and a power switch, wherein:

the spring element is provided between the base and the control pedal;

the power switch is mounted on the base and comprises a button having a first end and a second end, which can simultaneously move in opposite directions for turning the power on and off;

the control pedal is pivotally connected to the base and comprises a pushing actuating means, a first pressing actuating means and a second pressing actuating means, the first pressing actuating means and the second actuating means moving simultaneously with the control pedal to depress the first end and the second end of the button, respectively, and the first pressing actuating means engages the button to turn on the power when the control pedal is depressed, and the second pressing actuating means normally depresses the second end of the button to keep the power off by the spring tension of the clip spring;

further wherein the first pressing actuating means and the second actuating means have curved slant surfaces tilted in opposite directions.

7. The safety controller of claim 6, wherein the spring element is a compressible spring.

8. The safety controller of claim 6, wherein the slant surface of the first pressing actuating means engages the button to turn on the power when the control pedal is stepped downwardly.

9. The safety controller of claim 6, wherein the slant surface of the second pressing actuating means disengages the button to turn off the power when the control pedal is released and restored back to its normal state.

10. The safety controller of claim 6, wherein the slant surfaces of the first pressing actuating means and the second actuating means are curved surfaces.

* * * * *